US006220975B1

(12) United States Patent
Beazley

(10) Patent No.: US 6,220,975 B1
(45) Date of Patent: Apr. 24, 2001

(54) SWIMMING POOL WATER GAME GOAL APPARATUS

(76) Inventor: William W. Beazley, 12691 Mountain Crest, Los Angeles, CA (US) 90049

( * ) Notice: Subject to any disclaimer, the term of this patent is extended or adjusted under 35 U.S.C. 154(b) by 0 days.

(21) Appl. No.: 09/442,662

(22) Filed: Nov. 18, 1999

(51) Int. Cl.[7] ..... A63B 67/00
(52) U.S. Cl. ..... 473/466
(58) Field of Search ..... 473/466, 481, 473/469, 471, 476, 478, 454, 456; 273/398–402, 348, 350

(56) References Cited

U.S. PATENT DOCUMENTS

| | | | | |
|---|---|---|---|---|
| 2,818,254 | | 12/1957 | Dunn | 273/1.5 |
| 4,220,337 | | 9/1980 | Moore | 273/395 |
| 4,715,599 | | 12/1987 | Raymond et al. | 273/1.5 R |
| 4,717,150 | | 1/1988 | Pribnow | 273/1.5 R |
| 4,759,545 | | 7/1988 | Grable | 273/1.5 R |
| 4,973,054 | | 11/1990 | Metrosky | 273/1.5 R |
| 5,000,461 | * | 3/1991 | Borazjani | 273/401 |
| 5,037,093 | | 8/1991 | Roark, Jr. | 273/1.5 R |
| 5,149,086 | | 9/1992 | Ziff | 273/15 R |
| 5,316,315 | | 5/1994 | Roarke, Jr. | 273/1.5 R |
| 5,332,230 | * | 7/1994 | Benedict | 273/400 |
| 5,611,531 | * | 3/1997 | Skerlan | 273/402 |
| 5,779,570 | * | 7/1998 | Bear | 273/401 |
| 6,113,506 | * | 9/2000 | Nielsen | 473/466 |

* cited by examiner

*Primary Examiner*—Mark S. Graham
(74) *Attorney, Agent, or Firm*—Jack C. Munro

(57) ABSTRACT

A game goal apparatus that is intended to be played within a swimming pool which uses a substantially planar backboard at opposite ends of the swimming pool. Each backboard is designed to be used in conjunction with a water polo ball. Each backboard includes a through opening which connects with a net mounted on the backboard to guide the ball when the ball passes through the through opening to be deposited on the water directly adjacent the rear surface of the backboard. The backboard is to be mounted on a frame which has a forward section which is located within the water of the swimming pool and a rearward section supportingly mounted on the swimming pool decking. The backboard is tilted to assume an inclined position so that upon the ball striking the surface of the backboard it rebounds in an upward direction away from the surface of the water of the swimming pool.

9 Claims, 4 Drawing Sheets

SWIMMING POOL WATER GAME GOAL APPARATUS

BACKGROUND OF THE INVENTION

1) Field of the Invention

This invention is directed to a goal in the form of a backboard which is to be mounted in conjunction with a swimming pool with the goal to be utilized in conjunction with a ball which is played between a pair of teams with proper placement of the ball in conjunction with the backboard generating a score for the team.

2) Description of the Prior Art

It has been popular, for many years, to play ball games in conjunction with swimming pools. One form of a game is called water polo. Water polo is played between opposing teams with there being located within the confines of the swimming pool a pair of oppositely located goal in the form of a net. It is the intention of each player to throw the water polo ball into the opposing teams goal. Most swimming pools provide little means for enjoyment of the pool other than merely swimming within the pool. Therefore, to use a ball game in conjunction with the swimming pool expands the usage of the swimming pool.

In the past, it has been known to construct goals to be mounted in conjunction with the edge of a swimming pool. A typical goal may include a basketball hoop and net with it being the intention of a player to throw a ball through the hoop and net with an opposing player attempting to prevent that player from so throwing of the ball. The basketball hoop and net are located some elevated distance above the surface of the water of the swimming pool. The scoring procedure requires that a player throw the ball in an arc with it being intended that it is to pass through the hoop and the net. It is the intention of this invention to construct a goal that is located directly adjacent the surface of the water so a water polo type of ball game can be played which is different from the basketball type of game.

SUMMARY OF THE INVENTION

One of the objectives of the present invention is to incorporate a goal apparatus to be used in conjunction with a game that is played similar to water polo.

Another objective of the present invention is to construct a goal apparatus which facilitates portability therefore making it easy to place the goal apparatus within a swimming pool in order to play the game and also facilitate extraction of the goal apparatus from the pool for placement in a storage location when not playing of the game.

Another objective of the present invention is to construct a goal apparatus which can be manufactured relatively inexpensively thereby minimizing the overall cost that is required in order to play the game of this invention.

When playing of the game generally there will only be used one goal apparatus of the present invention. However, if the field of play permitted, two separate goals may be used on opposite ends of the swimming pool. Each goal apparatus is identical and each comprises a frame with the forward section of the frame removably mounted onto a backboard. The bottom edge of the backboard is designed to be located just at or below the surface of the water within the swimming pool. The backboard is to include a through hole. Mounted in conjunction with the through hole is a net. A ball is to be thrown through the through hole and into the net which functions to guide the ball to a location just rearward of the backboard facilitating grasping of the ball to continue play of the game after a goal is scored. The backboard also may include target areas which can be utilized when practicing of the game in order to rebound the ball back to the player that has thrown the ball to the backboard. The backboard is to be mounted at an upwardly inclined position so that upon a ball striking the backboard, the ball will be rebounded up into the air above the surface of the pool so as to avoid rebounding in the area directly adjacent the backboard. The rearward section of the frame of the goal apparatus includes two different sets of wheels. One set of wheels is to facilitate movement of the goal apparatus in a longitudinal direction with the second set of wheels to facilitate movement of the goal apparatus in a transverse direction. The movement of the goal apparatus is to be to and from a storage location. The rearward section also includes a ballast tank to add weight to the goal apparatus so as to keep it in a fixed location during the playing of the game.

DETAILED DESCRIPTION OF THE PREFERRED EMBODIMENT

Figure 1:
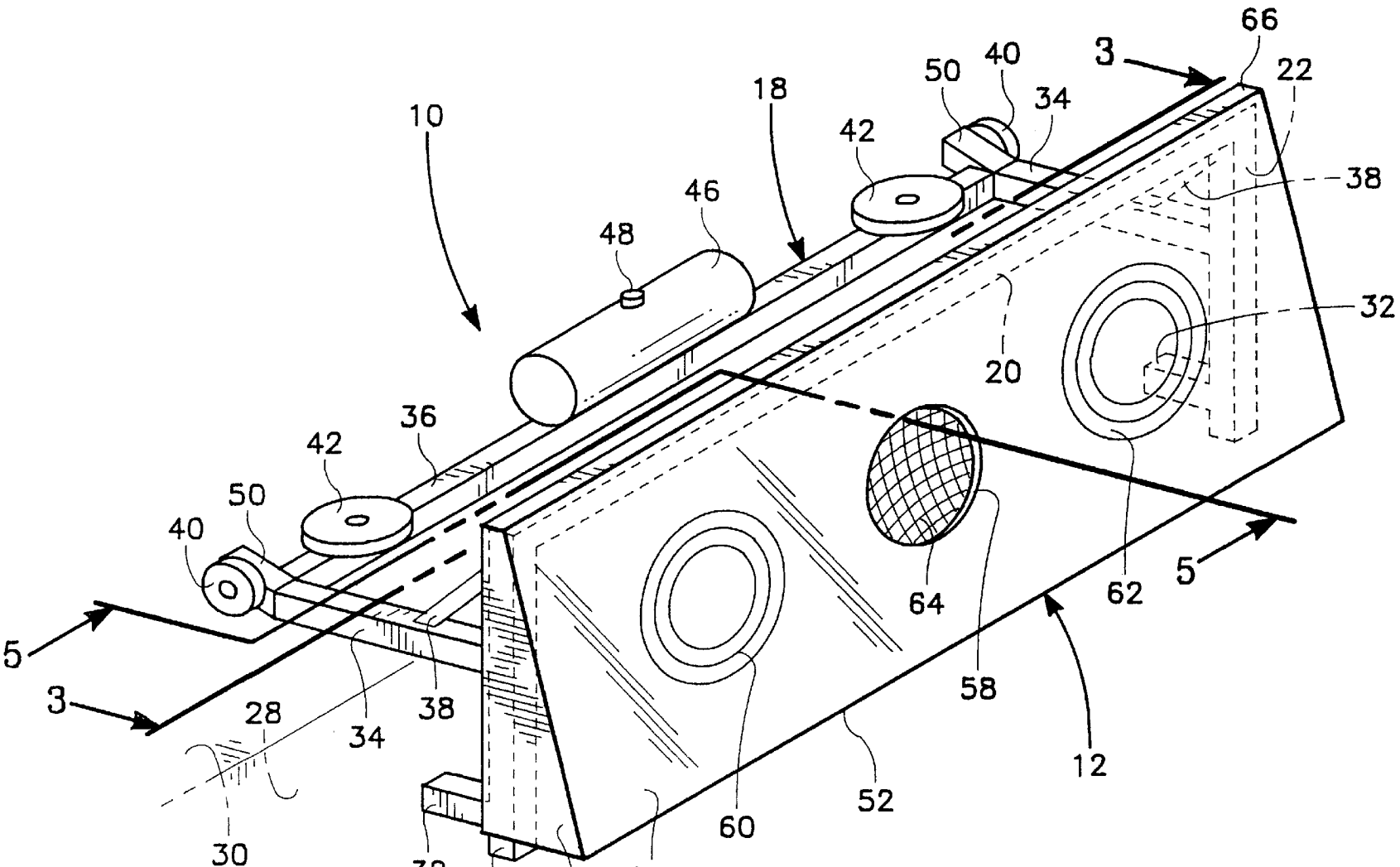
FIG. 1 is a front isometric view of the water game goal apparatus of the present invention.
Figure 2:
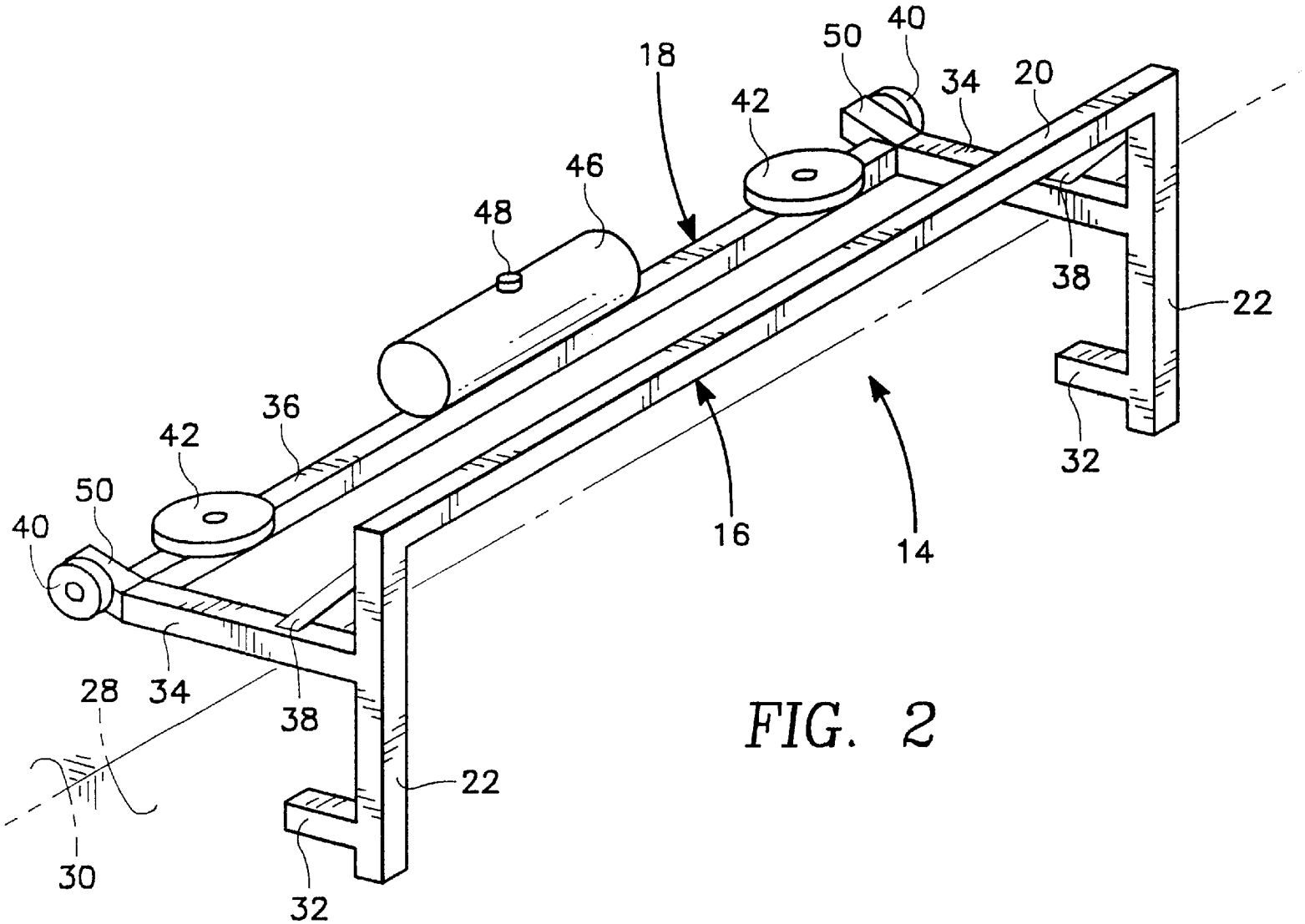
FIG. 2 is a front isometric view of the frame of the water game goal apparatus of the present invention with the backboard having been removed.
Figure 3:
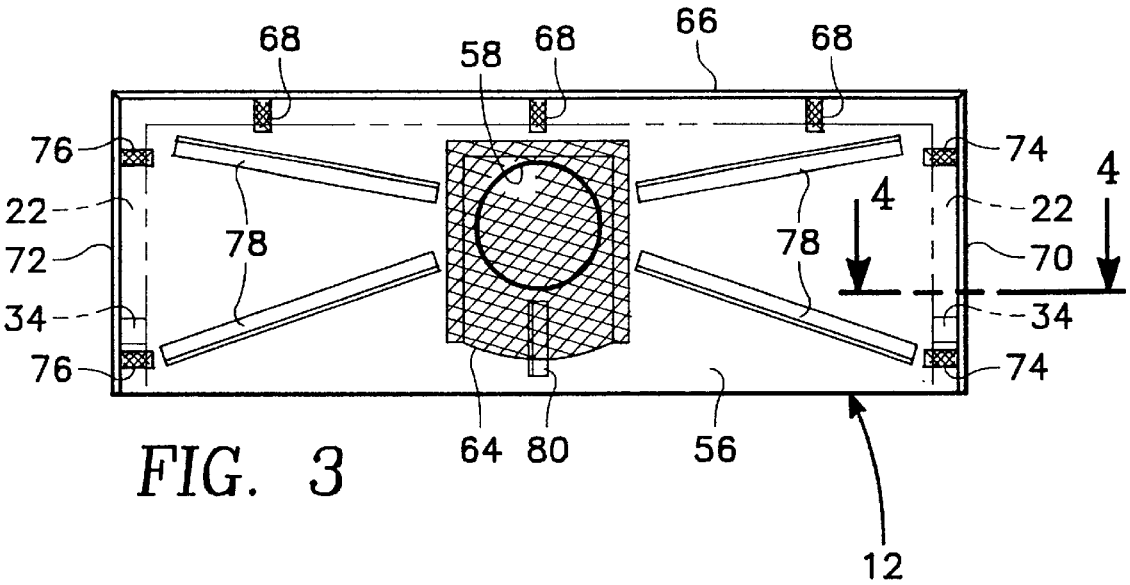
FIG. 3 is a back view of the backboard utilized in conjunction with the water game goal apparatus of the present invention.
Figure 4:
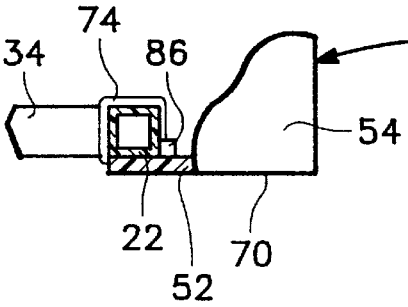
FIG. 4 is a cross-sectional view of the water game goal apparatus of the present invention taken along line 4—4 of FIG. 3.

Referring particularly to the drawings, there is shown the water game goal apparatus 10 of this invention. The goal apparatus 10 is composed of a backboard 12 and a frame 14. The frame 14 is constructed of a plurality of rigid tubular plastic members in the form of a front section 16 which is integrally connected to a rearward section 18. The front section 16 is composed of a main horizontal member 20 which generally will be several feet in length. Integrally attached at each end of the main horizontal member 20 is a vertical member 22 with it being understood that there are two in number of the vertical members 22 located parallel to each other. Vertical members 22 are also of the same length and are such a length that when the goal apparatus 10 is installed in position for usage that the members 22 will be located just beneath the surface 24 of the water 26 that is confined within a swimming pool.

The swimming pool includes a sidewall 28 and a decking 30. Integrally connected to each vertical member 22 is a brace 32 with it being understood that there are two in number of the braces 32 with there being one brace 32 attached to each vertical member 22. Each brace 32 extends in a transverse direction from its respective vertical member 22 and is located directly adjacent the outer free end of each vertical member 22. The braces 32 are selected to be of a length so that when the goal apparatus 10 is installed in position that the braces 32 will come into contact with the sidewall 18 of the swimming pool.

The rearward section 18 is defined by a pair of spaced apart, parallel horizontal members 34 which are connected together at their free outer end by a longitudinal horizontal brace member 36. Each horizontal brace member 34 is braced with its respective vertical member 22 by an inclined brace member 38. The function of the inclined brace members 38 are to keep the rearward section 18 fixed in position and located substantially at a right angle to the front section 16.

Figure 6:
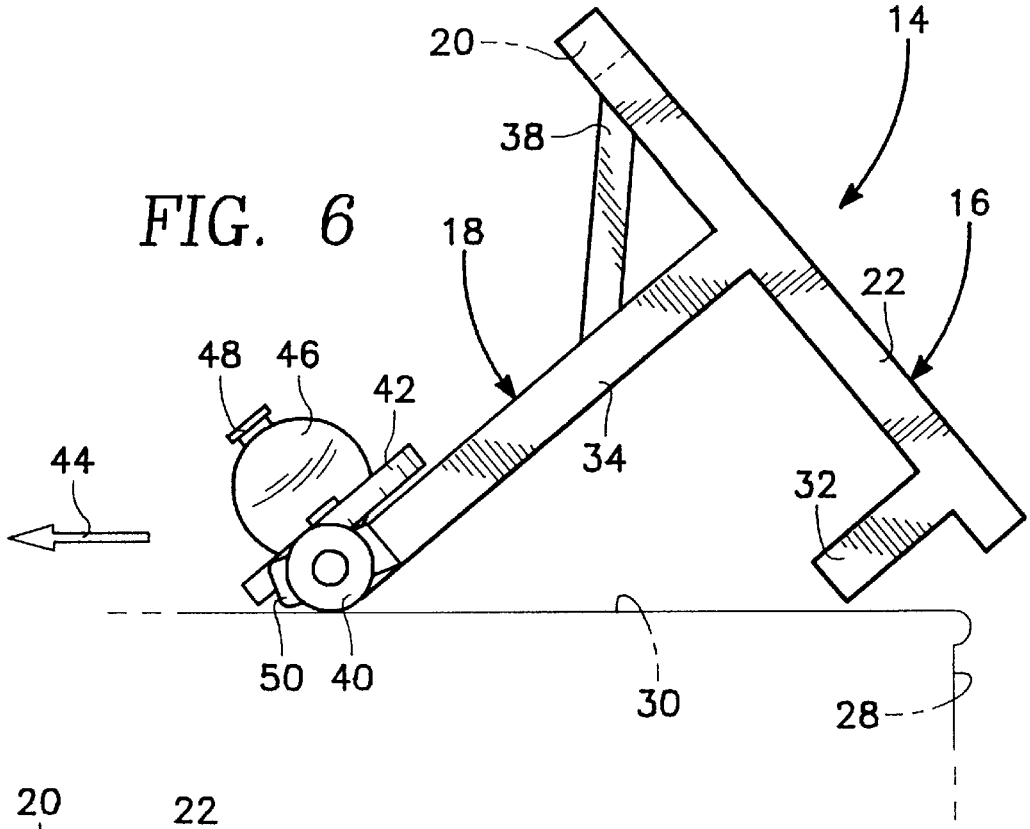
FIG. 6 is a side view of the water game goal apparatus of the present invention showing how the goal apparatus can be moved in the longitudinal direction.
Figure 7:
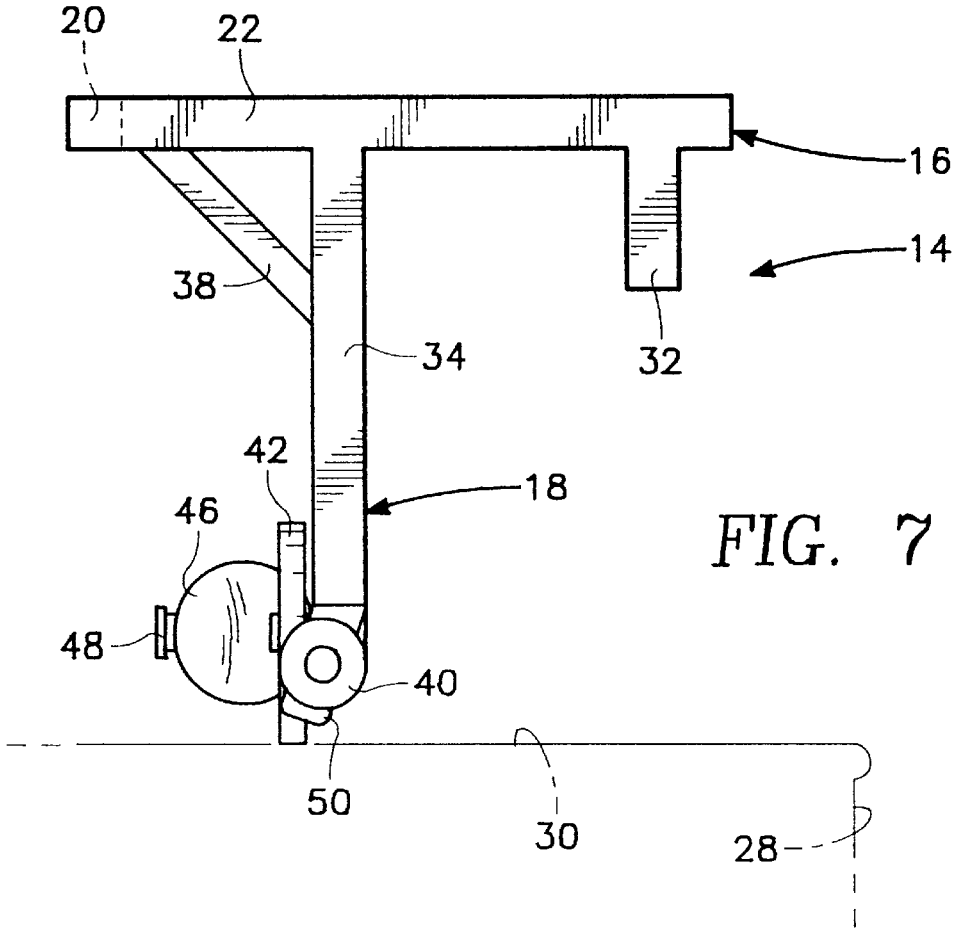
FIG. 7 is a side elevational view of the water game goal apparatus of the present invention showing how the goal apparatus can be moved in the transverse direction.

Mounted at the outer end of each horizontal member 34 is a wheel 40. It is to be understood that there are two in number of the wheels 40 with each wheel 40 being pivotally mounted on its respective horizontal member 34. The wheels 40 are to function in unison so that when the frame 14 is in the position shown in FIG. 6 of the drawing, it can be moved longitudinally by rolling on the wheels 40.

Figure 5:
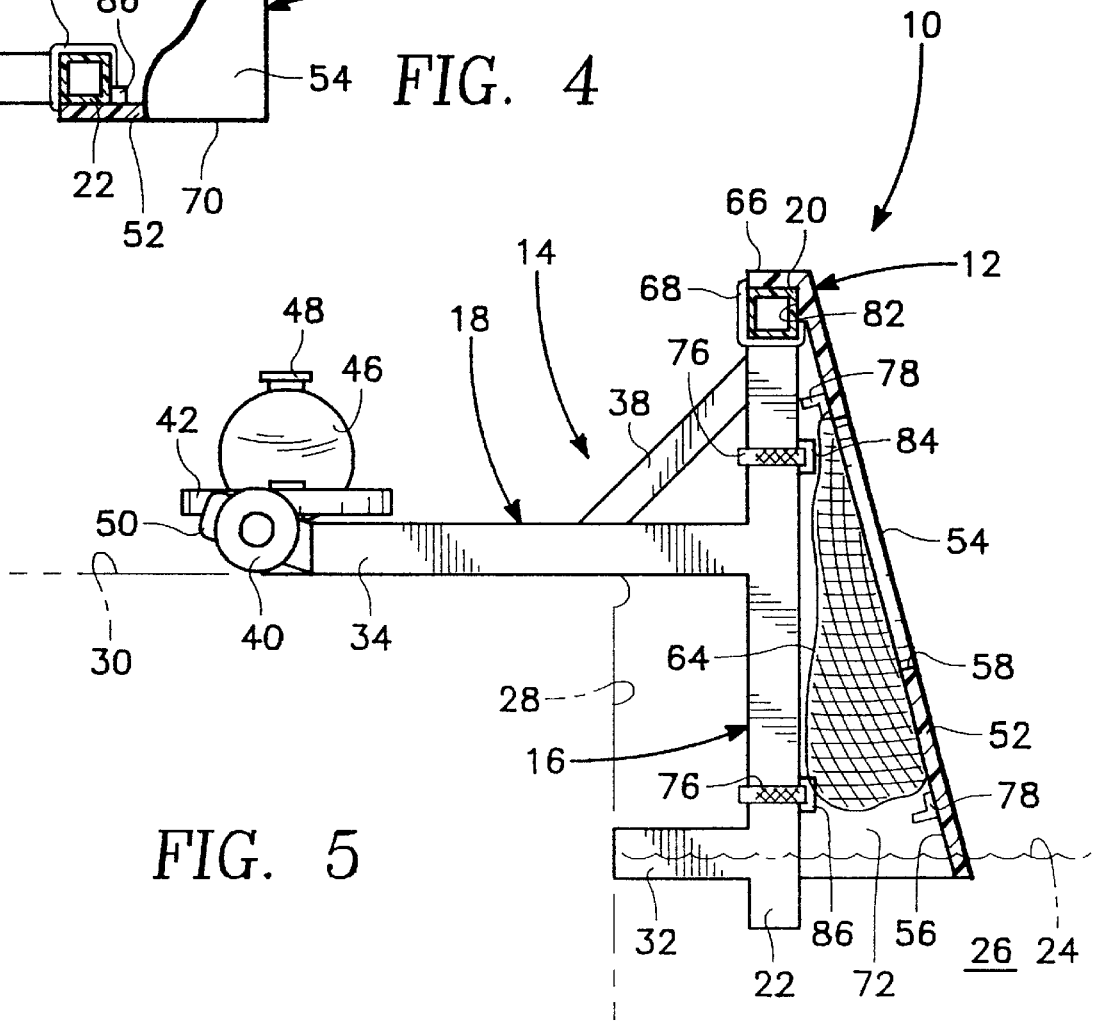
FIG. 5 is a side view, partly in cross-section, of the water game goal apparatus of the present invention taken along line 5—5 of FIG. 1.

It is to be noted that each wheel 40 is pivotally mounted on a slanted section 50 with their being a separate slanted section 50 attached to each horizontal member 34. The purpose of each slanted section 50 is so that when the horizontal members 34 are placed in contact and resting on the decking 30, as shown in FIG. 5 of the drawings, that the wheels 40 are just in contact with the decking 30. If it were not for the slanted sections 50, the horizontal members 34 would not be in flush contact with the decking 30.

Mounted on the longitudinal horizontal brace member 36 are a pair of wheels 42. It is to be noted that the wheels 42 are of substantially larger diameter than the wheels 40. The wheels 40 are to be in contact with the decking 30 when the horizontal members are located substantially at a forty-five degree angle relative to the decking 30. In this position, the wheels 42 are not in contact with the decking 30. This permits the longitudinal manual movement in the direction of arrow 44 of the frame 14. However, when the frame 14 is pivoted an additional forty-five degrees, the horizontal members 44 are then located substantially vertical and wheels 42 will then be in contact with the decking 30 with the wheels 40 now being spaced from the decking 30. This will permit the transverse movement of the frame 14 in a direction substantially perpendicular to the direction of arrow 44. The frame 14 is to be movable by using of wheels 40 and 42 to locate the frame 14 in a storage location and then movement from the storage location to its usage position in conjunction with the swimming pool. It is to be understood that the wheels 42 are low frictionally pivotally mounted on the longitudinal horizontal brace member 36.

Fixedly mounted on the longitudinal horizontal brace member 36 is a ballast tank 46. The ballast tank 46 has an inlet pipe 48. Water is to be poured through the inlet pipe 48 to substantially fill the ballast tank 46 which will provide added weight so as to keep the water goal apparatus 10 in a fixed location when in use.

The backboard 12 is defined principally by a main planer section 52 which is generally rectangular in configuration comprising three to four feet in height and eight to ten feet in length. This main section has a front surface 54 and a rear surface 56. Centrally located and formed through the backboard 12 from the front surface 54 to the rear surface 56 is a through opening 58. The size of the through opening 58 will generally be about twice the size of the ball that is to be used in conjunction with the game with the goal apparatus 10 of this invention. With the ball being generally about ten inches in diameter, this means that the through opening 58 will normally be about twenty inches in diameter. However, it is to be considered within the scope of this invention that the through opening 58 could be larger or smaller in size.

There may also be included on the front surface 54 a target area, such as targets 60 and 62. The function of the targets 60 and 62 is to permit a player to aim for the targets 60 and 62 which will have the ball rebound from the backboard 12 in a direction upward above the surface 24 of the water 26. It is to be noted that the targets 60 and 62 are shown as being a series of concentric circles. However, any configuration of targets 60 and 62 could be utilized without departing from the scope of this invention.

Mounted on the rear surface 56 about the through opening 58 is a net 64. The function of the net 64 is as a guiding device so that when the ball is propelled through through hole 58 that it comes into contact with the net 64 which will guide the ball in a straight down direction toward the surface 24 of the water 26 and position the ball directly adjacent the rear surface 56. To the players of the game, upon a ball being propelled through the through opening 58, the players know that the ball will be located directly beneath the through opening 58 so the player only needs to reach under the backboard 12 and grab the ball and extract such from its position for continued play of the game. The net 64 is of a length that is short of coming into contact with the surface 24 of the water 26.

The backboard 12 is integrally connected to a top edge 56. Mounted in conjunction with the top edge 56 are a series of straps 68 with three in number of the straps 68 being shown. It is the function of the straps 68 to securely mount the top edge 66 onto the main horizontal member 20 with member 20 abutting against surface 82 of backboard 12. The straps 68 will include fastening means, which is commonly sold under the trade name Velcro which comprises a pair of pads, with one pad including a mass of tiny eyelets and the other pad including a mass of tiny hooks.

Also integrally connected to the backboard 12 are side panels 70 and 72. The side panels 70 and 72 are of the same size and are of the same configuration. It is to be noted that each side panel 70 is narrow where it connects with the top edge 66 and is substantially wider where it connects at the bottom of the backboard 12. Side panel 70 has a pair of straps 74, similar to straps 68, which are used to fixedly secure the side panel 70 onto one of the vertical members 22 with vertical member 22 abutting against stop members 84 and 86 mounted on side panel 70. In a similar manner, side panel 72 has a pair of straps 76 which are similar to straps 68 which are used to fixedly secure the side panel 72 onto the remaining vertical member 22 with vertical member 22 abutting against stop members 84 and 86 of side panel 72. It is to noted that when the goal apparatus 10 of this invention is in use, the main section 52 of the backboard 12 assumes a forwardly inclined position of about twelve degrees. This inclination is such that when a ball is directed in contact with the front surface 54 that the rebounding of the ball will be in a direction upward and away from the surface 24 of the water 26. This will permit a single player to be able to practice by throwing at the backboard 12 and having the ball to bounce back to be located directly adjacent the player not requiring the services of any additional player. Targets 60 and 62 are to be used for this purpose. The through opening 58 is to be used when playing of the actual game rather than practicing.

Fixedly mounted on the rear surface 56 are a plurality of longitudinal ribs 78. It is the function of the longitudinal ribs

78 to prevent deflection of the main section 52 so that it will be maintained substantially planer at all times. Also fixedly mounted on the rear surface 56 is a short rib 80 for the same purpose.

What is claimed is:

1. A water game goal apparatus to be used in a swimming pool comprising:

a frame having a forward section and a rearward section, said forward section adapted to be located within water of a swimming pool, said rearward section adapted to rest on a decking of a swimming pool;

a substantially planar backboard mounted on said forward section, said backboard having a front surface and a rear surface, said front surface adapted to face toward the majority of the water area of a swimming pool, said rear surface facing toward said rear section, said backboard having a through hole that extends from front surface to said rear surface; and ball guiding means mounted on said rear surface of said backboard, said ball guiding means being located about said through hole, whereby in the playing of a game a ball is to be thrown to enter said through hole and contact said ball guiding means which directs the ball to be deposited on the water surface of the swimming pool directly adjacent said rear surface.

2. The water game goal apparatus as defined in claim 1 wherein:

said through hole being centrally located within said backboard.

3. The water game goal apparatus as defined in claim 1 wherein:

said backboard being tilted assuming an inclined position relative to horizontal.

4. The water game goal apparatus as defined in claim 1 wherein:

said backboard including at least one target located in close proximity to but spaced from said through hole, said target being mounted on said front surface.

5. The water game goal apparatus as defined in claim 1 wherein:

said rearward section including wheel means, said wheel means to be usable for moving of said frame on a decking of a swimming pool.

6. The water game goal apparatus as defined in claim 5 wherein:

said wheel means comprising a first set of wheels and a second set of wheels, said first set of wheels to be usable to move said frame in a longitudinal direction, said second set of wheels to be usable to move said frame in a transverse direction.

7. The water game goal apparatus as defined in claim 1 wherein:

said frame including a ballast, said ballast being mounted on said rearward section.

8. The water game goal apparatus as defined in claim 1 wherein:

said forward section of said frame including brace means, said brace means to be positioned against a sidewall of a swimming pool when said water game goal apparatus is properly installed for usage.

9. The water game goal apparatus as defined in claim 1 wherein:

said ball guiding means comprising a net.

* * * * *